United States Patent [19]

Schäfer

[11] 4,159,031

[45] Jun. 26, 1979

[54] FLASK FOR SAND MOLDS WHICH ARE TO BE FILLED WITH METAL

[75] Inventor: Klaus Schäfer, Rapperswil, Switzerland

[73] Assignee: Foundry Design Corporation/Europe, Rapperswil, Switzerland

[21] Appl. No.: 861,363

[22] Filed: Dec. 16, 1977

[30] Foreign Application Priority Data

Dec. 23, 1976 [CH] Switzerland ..... 16234/76

[51] Int. Cl.[2] ..... B22C 21/14

[52] U.S. Cl. ..... 164/383

[58] Field of Search ..... 164/379, 380, 381, 382, 164/383, 394, 391, 392, 410, 412, 213, 214, 374, 375, 387

[56] References Cited

U.S. PATENT DOCUMENTS

| | | | |
|---|---|---|---|
| 947,261 | 1/1910 | Scrivenor | 164/381 |
| 3,621,525 | 11/1971 | Butcher | 164/404 |

*Primary Examiner*—Richard B. Lazarus
*Assistant Examiner*—John S. Brown
*Attorney, Agent, or Firm*—Blanchard, Flynn, Thiel, Boutell & Tanis

[57] ABSTRACT

A flask for producing sand-cast parts. To make unpacking of the cast parts easier and to achieve closer measurement tolerances on the same, baffle plates are provided in at least one part of the conical outside, which baffle plates can be tilted out or opened and project in the tilted-in or closed position inside of the flask. These have during the casting process the function of reinforcing the sand portions. After tilting out gas can escape and can be removed.

4 Claims, 4 Drawing Figures

FLASK FOR SAND MOLDS WHICH ARE TO BE FILLED WITH METAL

FIELD OF THE INVENTION

The invention relates to a flask for sand molds which are to be filled with metal, preferably iron or steel.

BACKGROUND OF THE INVENTION

In the field of the medium or large-size castings, traditional manufacturing methods with natural sands and subsequent drying processes have been mostly utilized. New mold materials have now been developed which permit a greater exactness in the sand mold manufacture. In the case of medium and larger castings, however, exposing the cast piece after casting is no longer sufficient for the demands of today for a logical operating process.

The safe control of the forces which occur during the casting process requires heavy flask parts, which are accordingly cumbersome to use. In order to provide closer measurement tolerances on the cast piece, the flask parts must be fixed and worked more exactly. One must thereby in addition consider that the unpacking of the cast pieces—the knocking out, exposing with removing tools, the shaking for unpacking, etc.—is still a rough method of operation and in addition illustrates an additional stress for the flask parts.

From all of these disadvantages results a high repair susceptibility and high expenses connected therewith, which makes impossible a competing of other working methods.

A sensible flask construction thus should not only assure a high stability and thus the goal of more close dimension tolerances, but is to contain also new possibilities for separating the flask and the sand mold after casting. As an important part of the set problem, a cleaning method for the flask parts must also be developed which is effective during separation in the interest of small forces.

The purpose of the invention is to increase the economy and produce an increase in production at a simultaneous increase in the preciseness of the finished work.

This is achieved with a flask of the above-mentioned type by inventively arranging in at least one part of the conical sidewalls of the flask frame holding-back baffle plates which are directed inwardly and can be tilted out or pulled out toward the outside of the mold.

With this one achieves a very much reduced outward power force onto the flask parts.

BRIEF DESCRIPTION OF THE DRAWINGS

Exemplary embodiments of the subject matter of the invention are illustrated in the drawings, in which.

DETAILED DESCRIPTION

Figure 1:
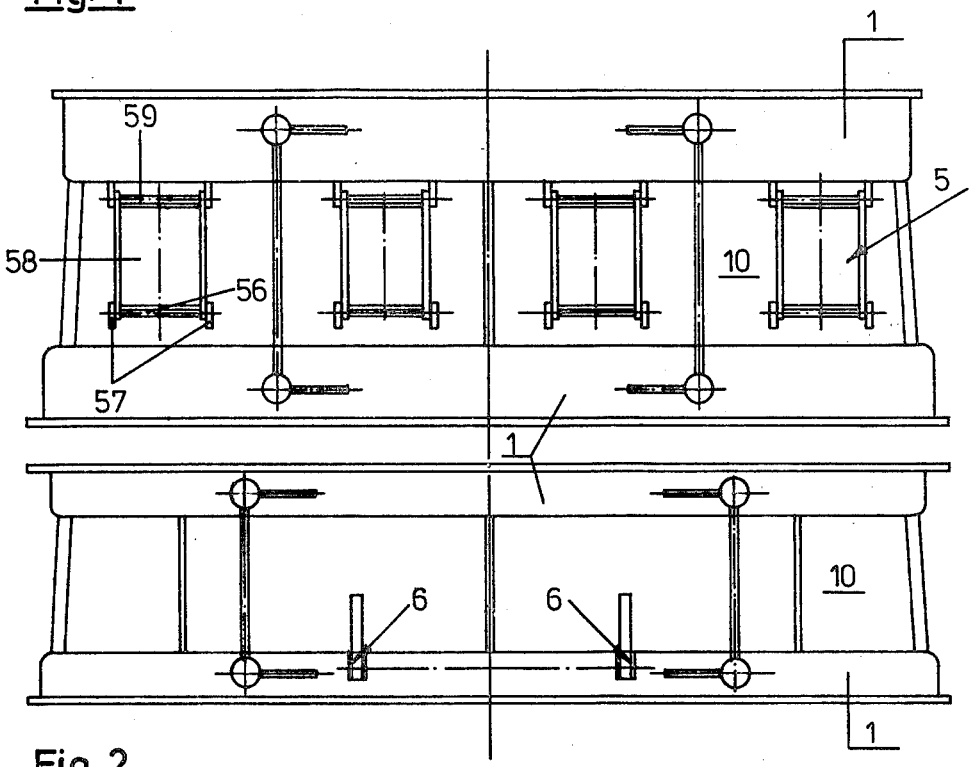
FIG. 1 is a longitudinal side view of two flasks which are arranged one on top of the other, however, the upper one not as yet set down onto the lower one and inventive baffle plates which can be tilted out from the longitudinal sides.
Figure 2:
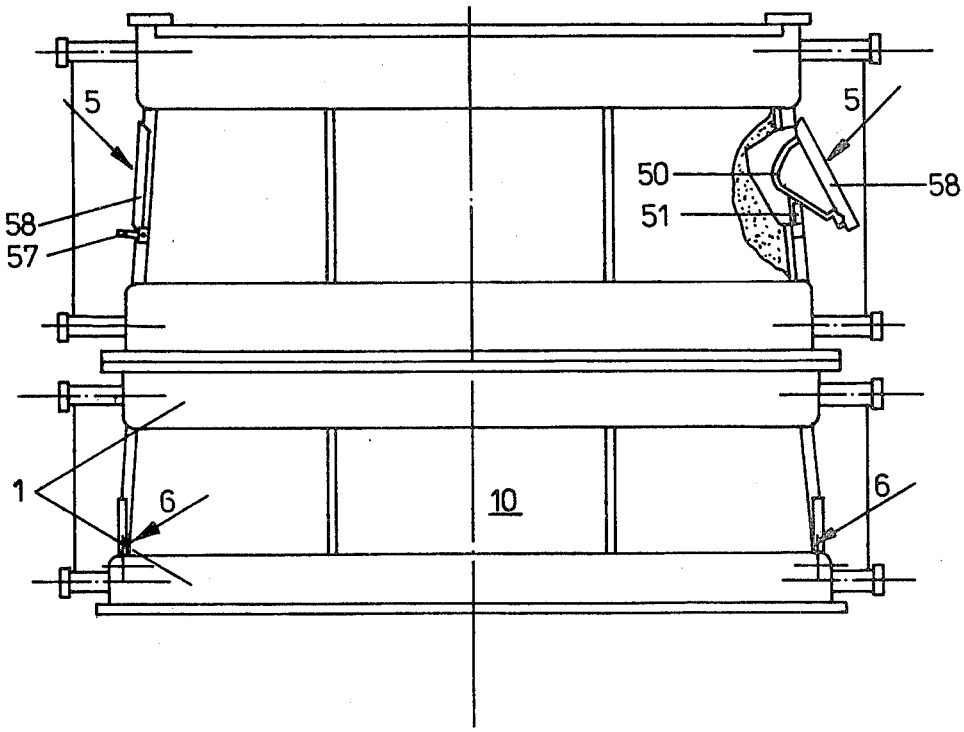
FIG. 2 is an end view of the wide side of the mounted flasks in partial cross section.
Figure 3:
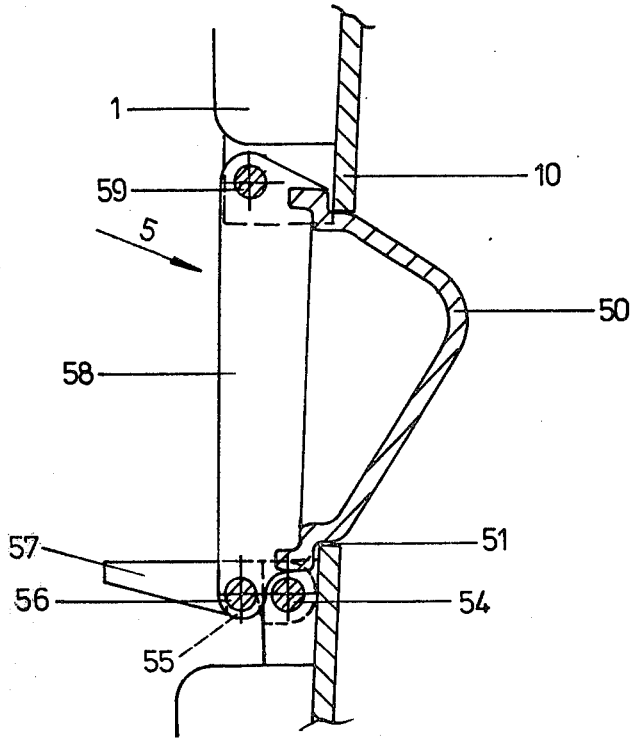
FIG. 3 is an enlarged cross-sectional view of a first modified embodiment of a baffle plate.
Figure 4:
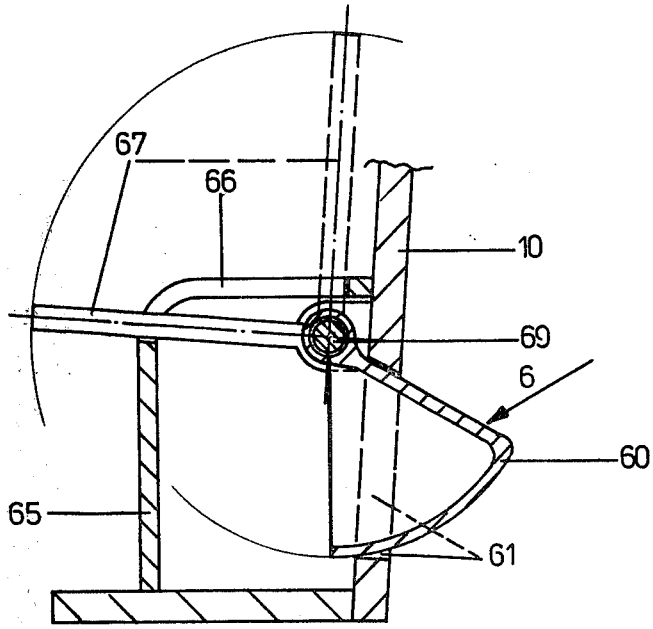
FIG. 4 is an enlarged cross-sectional view of a second modified embodiment.

FIGS. 1 and 2 each illustrate two flasks each having a fixed frame 10 with upper and lower connecting edges 1 and in the longitudinal side of the upper flask frame 10 and in the lower edge 1 of the lower frame there are arranged two baffle plates 5 and 6, respectively, of a differing construction. The baffle plate 5 in the upper flask frame is shown in detail in FIG. 3 whereas the baffle plate 6 of the lower flask frame is shown in detail in FIG. 4. Characteristic for both constructions is the swing-out possibility of a cam member 50 or 60 which projects into the interior of the flask frame.

The baffle plate 5 (FIG. 3) functions as a closure to open and close a passageway 51 in the wall of the flask frame and consists of a plate 58 with the cam member 50 secured thereto and supported pivotally on a shaft 59 mounted on the outside of the frame 10. A rod 56 is provided on the lower edge of the plate 58 and serves to secure the baffle plate 5 in the closed condition. The rod 56 is received in a slot 55 in a lever 57 which is pivotally supported on a shaft 54 provided on the frame 10. To release the lock, it is sufficient to lift the lever 57 so that the lower edge of the plate 58 is released. The right side of FIG. 2 illustrates a baffle plate 5 which is swung out half way.

The baffle plate 6 (FIG. 4) functions as a closure to open and close a passageway 61 and consists of the cam member 60 which is pivotally supported on the shaft 69 provided on the flask frame 10. A hand lever 67 is fixedly connected to the member 60 and is guided in a slot 66 in an outer cover 65. The hand lever 67 is shown in two positions, namely, the full line closed position and the dashed open position for the baffle plate 6.

The cam members 50, 60 have, viewed in cross section, an almost triangular form and the upwardly facing and inclined side of the triangle forms an acute angle with the horizontal. To avoid damage to the sand mold packing, the downwardly facing and inclined side of the triangle must have such a sloped position that during a swinging out of the cam member, the tip or apex of the triangle, which initially projects into the mold, will not project beyond the limit of the downwardly facing and inclined side.

Both constructions of the cam members provide a holding-back member for the purpose of accommodating mold holding forces. Through a swivel motion from the flask, it is possible to release the fixation of the mold packing in the flask. The releasable holding device can, however, also be released with sliding guides or other means.

To secure the baffle plates, holding means like screws, locks, slide members, hooks, eccentrics or the like can be provided.

The locked holding-back baffle plates enhance the fixation of the mold packing in the flask; the swing-out possibility reduces the great power action and the stress on the box parts. The exact positioning which is necessary prior to casting is thereby assured. As a result, the heretofore used repair-susceptible traverses and baffle plates can be eliminated.

The baffle plates can already lightly be swung out during the actual casting operation so that gas can escape laterally from the passageway. Due to the triangular shape of the cam members, the baffle plate can, however, still support forces with respect to the sand mold.

For opening the mold, the baffle plates are driven out so that the cast piece smoothly slides out with the sand. The mold may be of a simple or two-step conicity.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. In a flask for sand molds which are to be filled with metal, wherein the improvement comprises a flask frame having at least one upwardly inclined sidewall, said sidewall having means defining at least one opening therein and baffle plate means with support means adjacent an upper edge of said baffle plate means supporting said baffle plate means for pivotal movement about a horizontal pivot axis between open and closed positions relative to said opening, the lower edge of said baffle plate means being movable from the closed position outward away from said sidewall toward said open position, said baffle plate means having a cam plate thereon which projects inwardly into said flask when said baffle plate means is in said closed position, said cam plate having a triangular shape viewed in a plane perpendicular to said pivot axis, the triangle formed by said cam plate having two vertically spaced and converging walls extending inwardly into said flask, the upper one of said walls forming an acute angle to the horizontal and extending downwardly away from a horizontal plane containing said pivot axis whereby when said baffle plate means is pivoted toward said open position, said upper wall will move downwardly away from the sand in said flask without disturbing same.

2. The improved flask according to claim 1, wherein the lower wall of said triangle has a sloped relation to the horizontal so that during an outward pivoting movement, the tip of the triangle which projects into said flask does not project below the limits of said lower wall so that the sand within the flask is not disturbed during a movement of said baffle plate means to said open position.

3. The improved flask according to claim 1, wherein said support means includes holding means arranged between said baffle plate and said sidewall for holding said baffle plate in said closed position.

4. The improved flask according to claim 1, wherein said baffle plate is pivotally supported on a shaft mounted on said sidewall and has a hand lever connected thereto and which extends outside of said mold frame.

* * * * *